US011072975B2

(12) United States Patent
Chen

(10) Patent No.: US 11,072,975 B2
(45) Date of Patent: Jul. 27, 2021

(54) SIDE-INSERTED CORD ROLLING DEVICE FOR NON-PULL CORD WINDOW BLIND

(71) Applicant: Po-Yu Chen, Taichung (TW)

(72) Inventor: Po-Yu Chen, Taichung (TW)

(73) Assignee: Jumbo Home Deco. Corporation (Cayman), Grand Cayman (KY)

( * ) Notice: Subject to any disclaimer, the term of this patent is extended or adjusted under 35 U.S.C. 154(b) by 246 days.

(21) Appl. No.: 16/297,995

(22) Filed: Mar. 11, 2019

(65) Prior Publication Data

US 2019/0323288 A1 Oct. 24, 2019

(30) Foreign Application Priority Data

Apr. 24, 2018 (TW) ..... 107113881

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 9/322; E06B 2009/3222
See application file for complete search history.

(56) References Cited

U.S. PATENT DOCUMENTS 5,482,100 A * 1/1996 Kuhar ..... E06B 9/32 160/170
6,601,635 B2 * 8/2003 Ciuca ..... E06B 9/32 160/170
6,837,294 B2 * 1/2005 Cheng ..... E06B 9/262 160/84.04
6,962,187 B2 * 11/2005 Gilmore ..... E06B 9/322 160/170
8,002,012 B2 * 8/2011 Cheng ..... E06B 9/322 160/170
8,087,445 B2 * 1/2012 DeWard ..... E06B 9/322 160/170
8,245,756 B2 * 8/2012 Cheng ..... E06B 9/322 160/170
8,297,332 B2 * 10/2012 Lin ..... E06B 9/322 160/170
8,893,763 B2 * 11/2014 Huang ..... E06B 9/80 160/170
9,121,221 B2 * 9/2015 Cheng ..... E06B 9/322
9,366,077 B2 * 6/2016 Chen ..... E06B 9/304
9,372,497 B2 * 6/2016 Wall ..... G05G 5/06
9,587,428 B2 * 3/2017 Huang ..... E06B 9/323
9,797,189 B2 * 10/2017 Huang ..... E06B 9/384
9,976,345 B2 * 5/2018 Chen ..... E06B 9/322
(Continued)

*Primary Examiner* — Johnnie A. Shablack
(74) *Attorney, Agent, or Firm* — Rosenberg, Klein & Lee

(57) ABSTRACT

A side-inserted cord rolling device for a non-pull cord window blind includes a base, first and second wheels disposed on the base and respectively located near an end plate and an opening provided at two ends of the base, a torsion spring, and two lift transmission cords. The first wheel has top, middle and bottom layers separated by disc portions. The torsion spring connects the bottom layer of the first wheel and the second wheel. An end of the lift transmission cords are connected to the top and middle layers of the first wheel respectively. Another end of the lift transmission cords are inserted through the opening of the base to be located out of the base for being connected with a bottom beam.

8 Claims, 8 Drawing Sheets

(56) References Cited

U.S. PATENT DOCUMENTS

| | | | | |
|---|---|---|---|---|
| 9,988,838 | B2 * | 6/2018 | Chen | E06B 9/322 |
| 10,612,299 | B2 * | 4/2020 | Chen | E06B 9/322 |
| 10,704,323 | B2 * | 7/2020 | Chen | E06B 9/322 |
| 10,704,658 | B2 * | 7/2020 | Chen | E06B 9/322 |
| 10,774,582 | B2 * | 9/2020 | Chen | F16H 19/0672 |
| 10,787,859 | B2 * | 9/2020 | Huang | E06B 9/322 |
| 10,822,870 | B2 * | 11/2020 | Chen | E06B 9/322 |
| 2006/0137831 | A1 * | 6/2006 | Lin | E06B 9/322 160/84.04 |
| 2007/0163727 | A1 * | 7/2007 | Cheng | E06B 9/30 160/170 |
| 2007/0227677 | A1 * | 10/2007 | Yu | E06B 9/322 160/170 |
| 2012/0032019 | A1 * | 2/2012 | Chen | E06B 9/322 242/378 |
| 2012/0061502 | A1 * | 3/2012 | Chen | E06B 9/322 242/372 |
| 2012/0097349 | A1 * | 4/2012 | Chen | E06B 9/262 160/371 |
| 2016/0290038 | A1 * | 10/2016 | Hung | E06B 9/322 |
| 2017/0298688 | A1 * | 10/2017 | Chen | F03G 1/00 |
| 2018/0202220 | A1 * | 7/2018 | Huang | E06B 9/322 |
| 2018/0291678 | A1 * | 10/2018 | Zheng | E06B 9/322 |
| 2019/0093426 | A1 * | 3/2019 | Huang | E06B 9/78 |
| 2019/0323288 | A1 * | 10/2019 | Chen | E06B 9/322 |
| 2019/0323289 | A1 * | 10/2019 | Chen | B65H 75/486 |
| 2019/0323291 | A1 * | 10/2019 | Chen | E06B 9/364 |
| 2020/0024896 | A1 * | 1/2020 | Lei | B65H 75/486 |

* cited by examiner

SIDE-INSERTED CORD ROLLING DEVICE FOR NON-PULL CORD WINDOW BLIND

BACKGROUND OF THE INVENTION

1. Field of the Invention

The present invention relates to non-pull cord window blinds and more particularly, to a side-inserted cord rolling device for a non-pull cord window blind.

2. Description of the Related Art

In general, as to the non-pull cord window blind, the lift transmission cord is rolled up by the cord rolling device disposed in the top beam. Because the lift transmission cord is tied to the bottom beam, the bottom beam is gradually moved up relative to the top beam during the process that the lift transmission cord is rolled up, so that the slats of the window blind are folded up by the upwardly moving bottom beam. However, in the prior art, the cord rolling device is usually located at the middle of the top beam, so the arrangement of other elements should be considered during the assembly or else the cord rolling device is liable to interfere with the aforesaid elements.

SUMMARY OF THE INVENTION

It is a primary objective of the present invention to provide a side-inserted cord rolling device for the non-pull cord window blind, which is easily installed and conveniently operated, thereby increased in usage convenience.

To attain the above objective, the side-inserted cord rolling device of the present invention includes a base, a first wheel, a second wheel, a torsion spring, and two lift transmission cords. The base is provided at an end thereof with an end plate. The base is provided at another end thereof with an opening. The first wheel is rotatably disposed on the base and located adjacent to the end plate of the base. The first wheel has a top layer, a middle layer and a bottom layer. The top layer and the middle layer are separated by a disc portion. The middle layer and the bottom layer are separated by another disc portion. The second wheel is rotatably disposed on the base and located adjacent to the opening of the base. The torsion spring connects the bottom layer of the first wheel and the second wheel. An end of one of the two lift transmission cords is connected to the top layer of the first wheel, an end of the other lift transmission cord is connected to the middle layer of the first wheel, and another end of each of the two lift transmission cords is inserted through the opening of the base to be located out of the base for being connected with a bottom beam.

It can be understood from the above description that the side-inserted cord rolling device of the present invention can be quickly installed at and removed from an end of a top beam and positioned in a way that the end plate of the base is abutted on an end surface of the top beam, thereby increased in usage convenience.

Preferably, the base has an upper half seat and a lower half seat connected with the upper half seat; the upper half seat is provided at an end thereof with an upper end portion; the lower half seat is provided at an end thereof with a lower end portion; the upper and lower end portions are abutted against each other to compose the end plate, so that the base can be positioned in the way that the end plate is abutted on the end surface of the top beam. Besides, the upper half seat is provided on the top surface thereof with two opposite guideways, so that the guideways of the upper half seat can increase the convenience of the installation of the device in the top beam.

Preferably, the base further has a middle plate disposed between the upper half seat and the lower half seat. A resistance adjusting module is disposed between the upper half seat and the middle plate of the base. The cord arrangement of the two lift transmission cords can be changed by one or a plurality of vertical rods of the resistance adjusting module in operation, so that the effect of resistance adjustment can be attained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
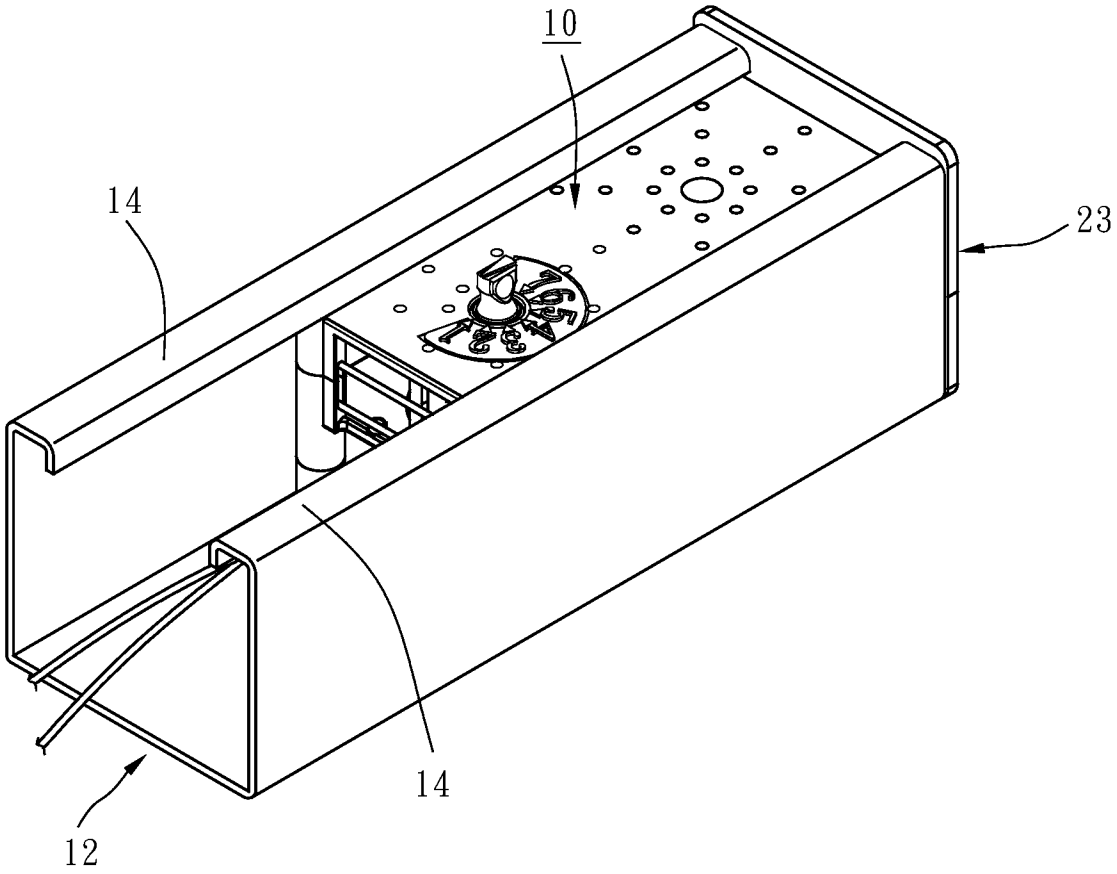
FIG. 1 is a perspective view of the partial appearance of a top beam and a side-inserted cord rolling device of the present invention installed in the top beam.

First of all, it is to be mentioned that same reference numerals used in the following preferred embodiments and the appendix drawings designate same or similar elements or features thereof throughout the specification for the purpose of concise illustration of the present invention.

Figure 2:
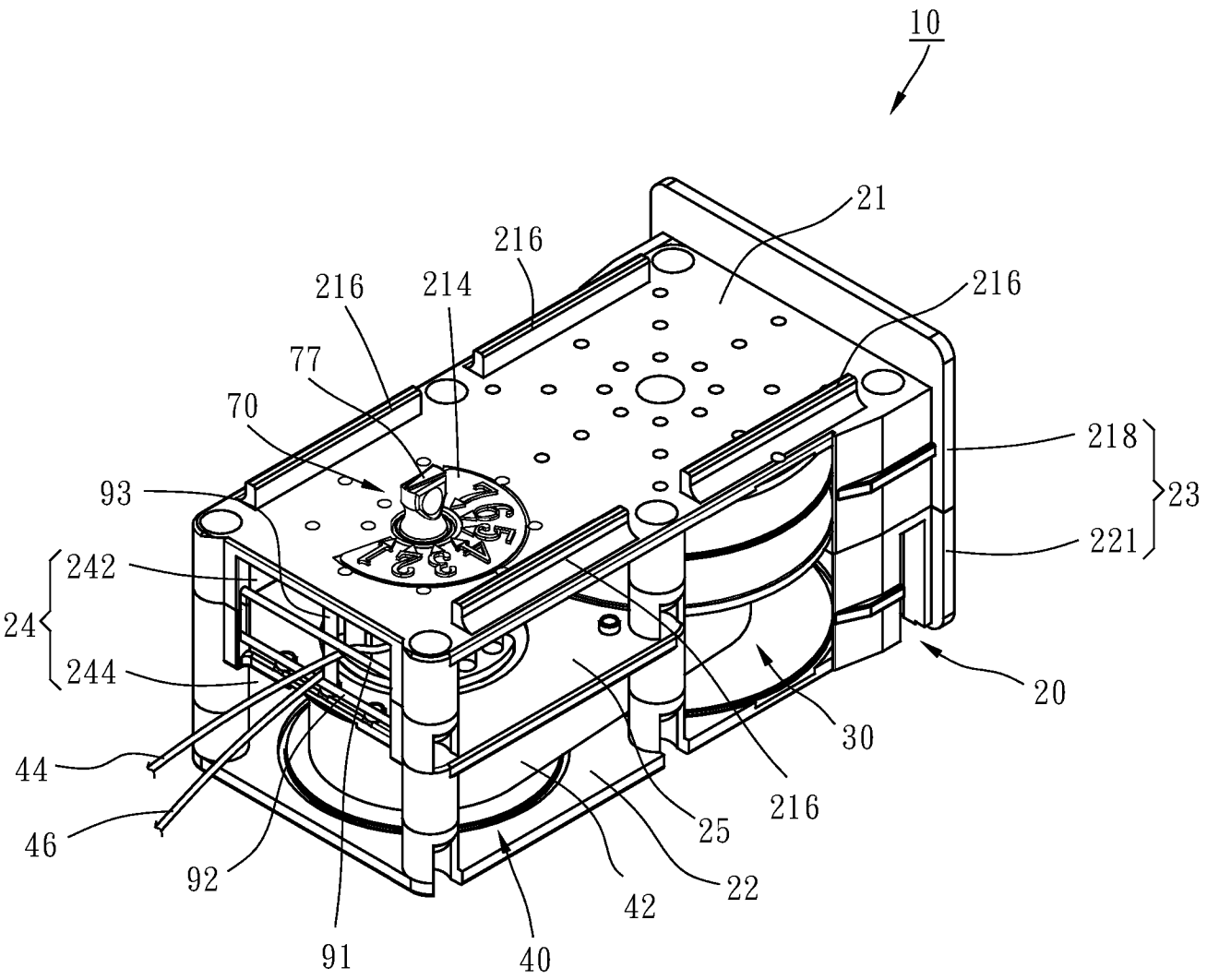
FIG. 2 is a perspective view of the appearance of the side-inserted cord rolling device of the present invention.

Referring to FIG. 2, the side-inserted cord rolling device 10 of the present invention includes a base 20, a first wheel 30, a second wheel 40, a torsion spring 42, and two lift transmission cords 44 and 46.

Figure 3:
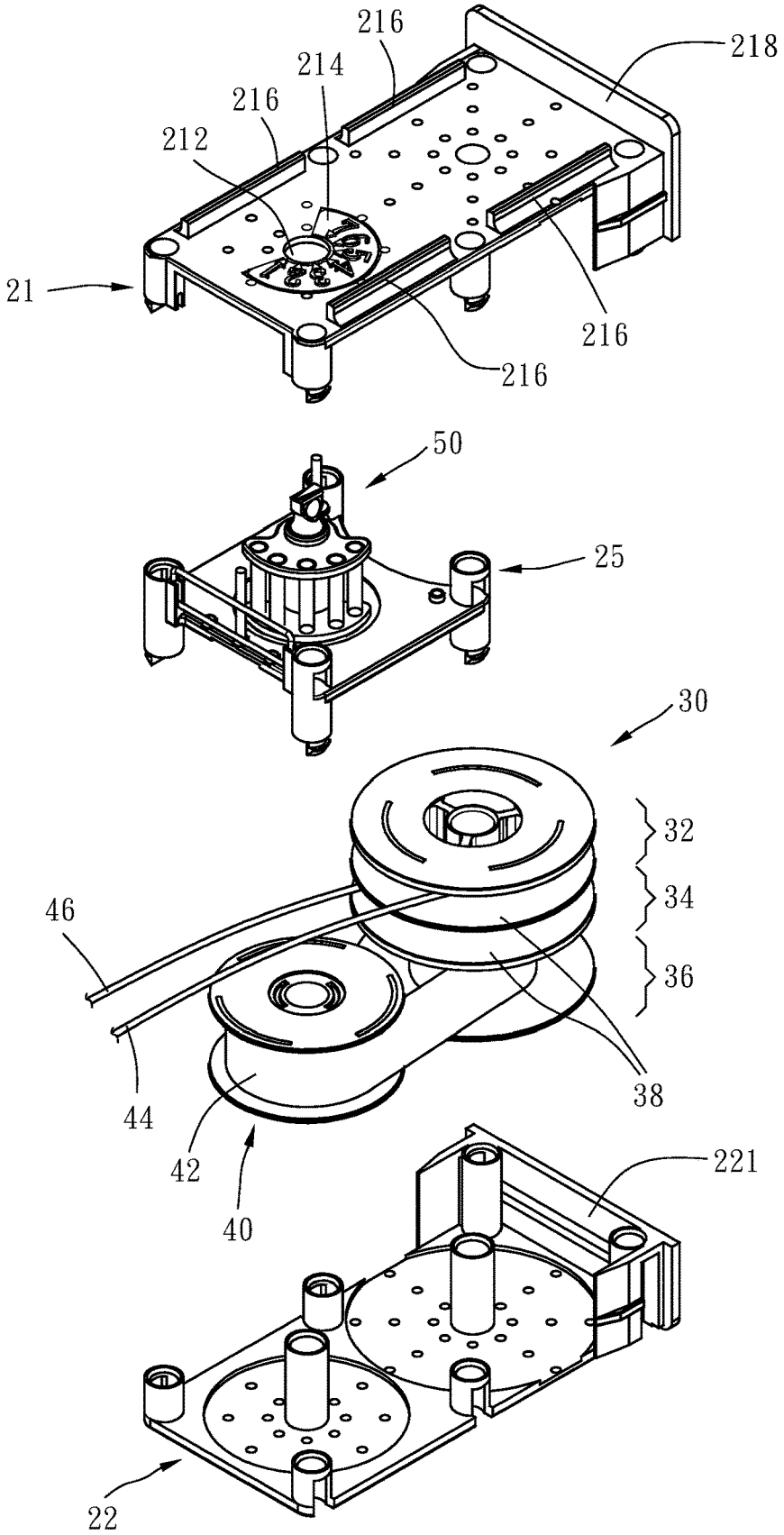
FIG. 3 is a partially exploded perspective view of the side-inserted cord rolling device of the present invention.

Referring to FIG. 3, the base 20 is composed of an upper half seat 21 and a lower half seat 22 connected with each other. The upper half seat 21 has a top hole 212 penetrating through the top and bottom surfaces of the upper half seat 21, and a plurality of state marks 214 located around the top hole 212 and represented by Arabic numerals. The upper half seat 21 is provided on the top surface thereof with two pairs of guideways 216 arranged side by side. Besides, the upper half seat 21 is provided at an end thereof with an upper end portion 218, and the lower half seat 22 is provided at an end thereof with a lower end portion 221. The upper end portion 218 of the upper half seat 21 and the lower end portion 221 of the lower half seat 22 are abutted against each other to compose an end plate 23. The other end of the base 20 is provided with an opening 24 opposite to the end plate 23.

Figure 4:
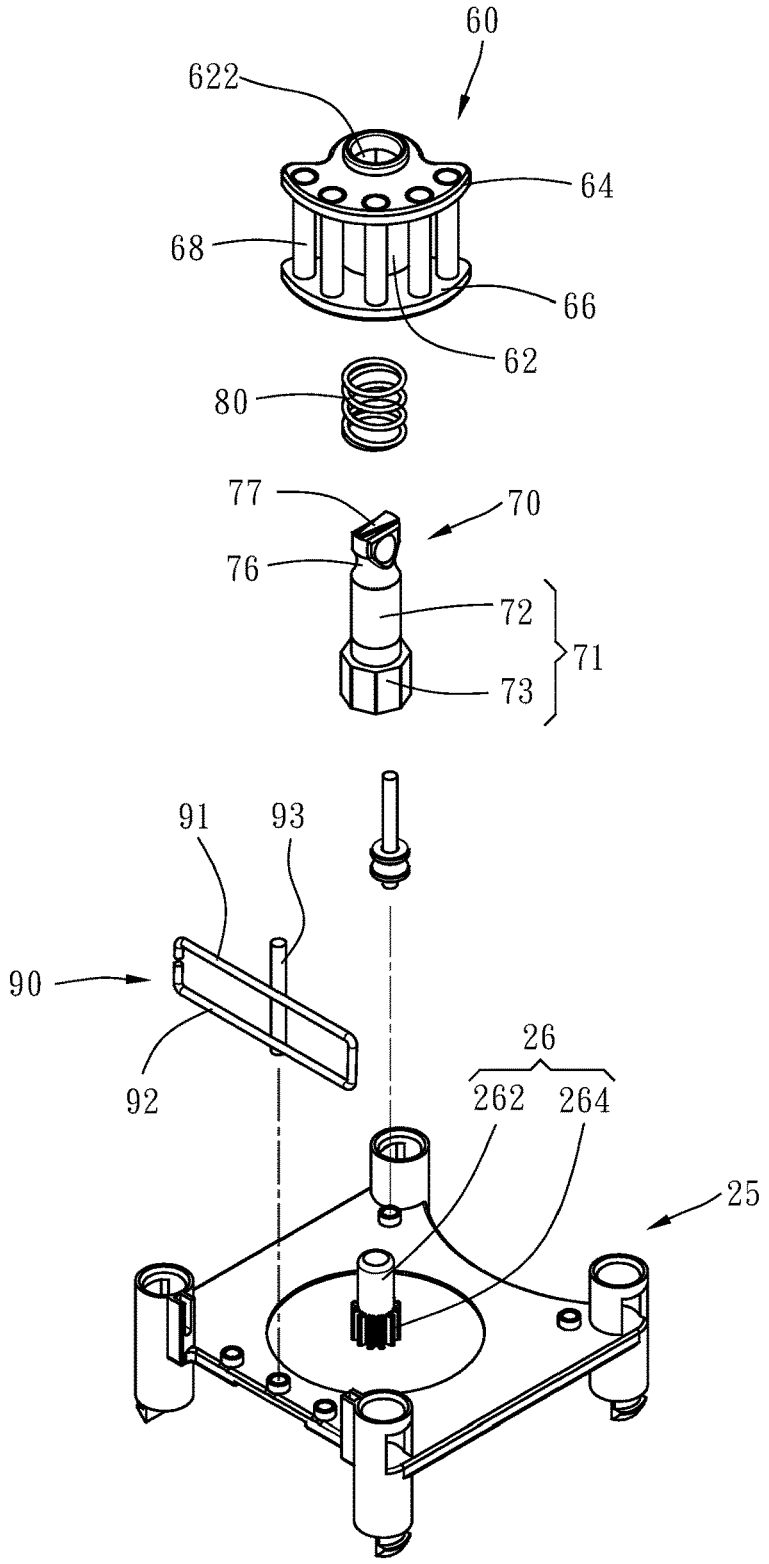
FIG. 4 is an exploded perspective view of a resistance adjusting module provided in the side-inserted cord rolling device of the present invention.

In addition, the base 20 further has a middle plate 25. The length of the middle plate 25 is approximately half the length of the upper or lower half seat 21 or 22. The middle plate 25 is disposed between the upper and lower half seats 21 and 22 and located adjacent to the opening 24 in a way that the opening 24 is divided into upper and lower half portions 242 and 244 by an end of the middle plate 25. Referring to FIG. 4, the middle plate 25 is provided on the top surface thereof with a fixed shaft 26 having an inner axial portion 262 which is circular in cross-section thereof and a positioning portion 264 which is toothed-shaped in cross-section thereof. The top end of the positioning portion 264 is integrally connected with the bottom end of the inner axial portion 262.

As shown in FIGS. 2 and 3, the first wheel 30 is rotatably disposed between the upper and lower half seats 21 and 22 of the base 20 and located adjacent to the end plate 23 of the base 20. The first wheel 30 is provided from the top to the bottom thereof in order with a top layer 32, a middle layer 34 and a bottom layer 36. The top and middle layers 32 and 34 are separated by a disc portion 38, and the middle and bottom layers 34 and 36 are separated by another disc portion 38.

The second wheel 40 is rotatably disposed between the upper and lower half seats 21 and 22 of the base 20 and located adjacent to the lower half portion 244 of the opening 24 of the base 20.

The torsion spring 42 is connected between the bottom layer 36 of the first wheel 30 and the second wheel 40 for providing resilient force to drive the first and second wheels 30 and 40 to rotate synchronously.

Figure 5:
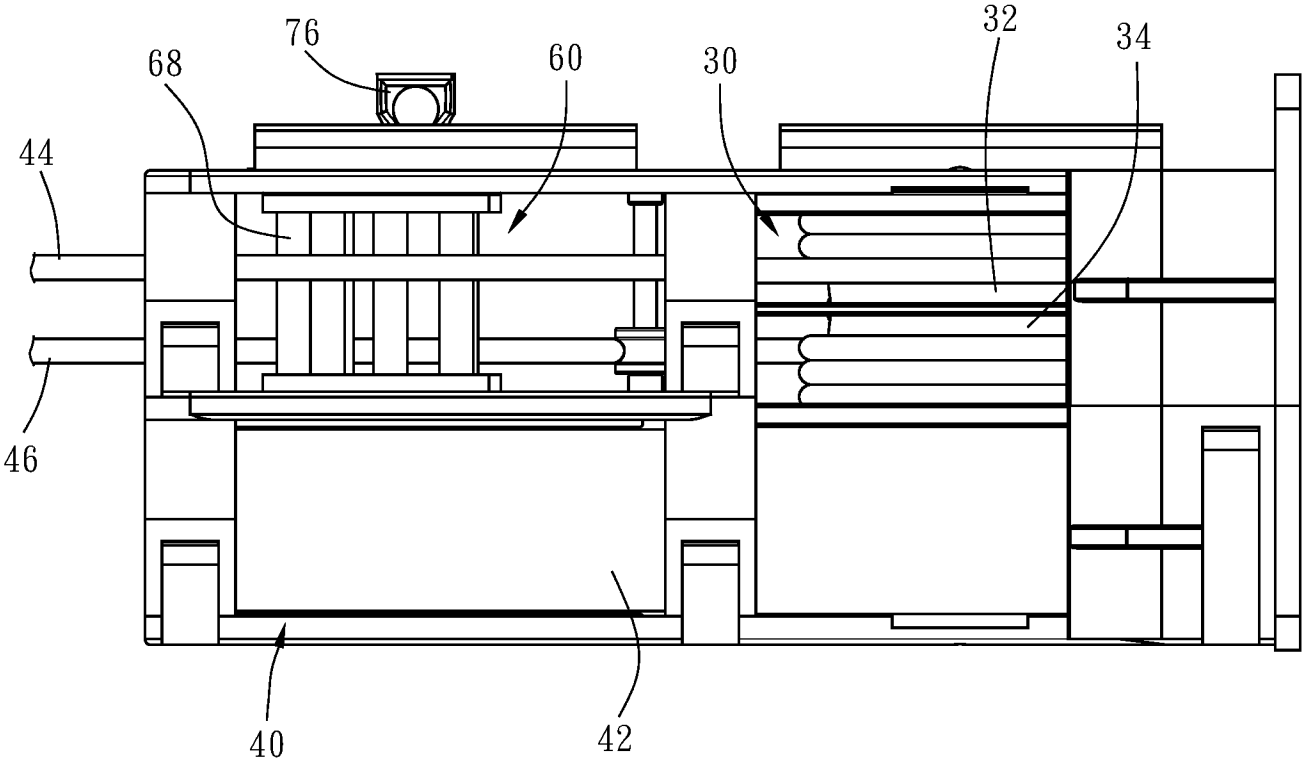
FIG. 5 is a lateral view of the side-inserted cord rolling device of the present invention.

As shown in FIGS. 2, 3 and 5, an end of the two lift transmission cords 44 and 46 are connected to the top and middle layers 32 and 34 of the first wheel 30 respectively, and the other end of the two lift transmission cords 44 and 46 are inserted through the upper half portion 242 of the opening 24 of the base 20 to be located out of the base 20 for being connected with a bottom beam (not shown).

It can be understood from the above structural illustration that when the two lift transmission cords 44 and 46 are pulled out to gradually escape from the top and middle layers 32 and 34 of the first wheel 30, the first wheel 30 starts to rotate and pull the torsion spring 42 by the bottom layer 36 during the rotation, causing the torsion spring 42 to further drive the second wheel 40 to rotate synchronously. At this time, the torsion spring 42 saves resilient force. When the pulling force applied on the two lift transmission cords 44 and 46 is relieved, the resilient force of the torsion spring 42 is applied on the bottom layer 36 of the first wheel 30 and the second wheel 40, causing the first and second wheels 30 and 40 to rotate reversely, wherein the first wheel 30 rolls up the two lift transmission cords 44 and 46 by the top and middle layers 32 and 34 respectively.

On the other hand, the present invention further provides a resistance adjusting module 50 for providing appropriate resistance to the two lift transmission cords 44 and 46 during the operation. As shown in FIG. 4, the resistance adjusting module 50 has a transmission seat 60, a pull pin 70, and an elastic member 80.

Figure 6:
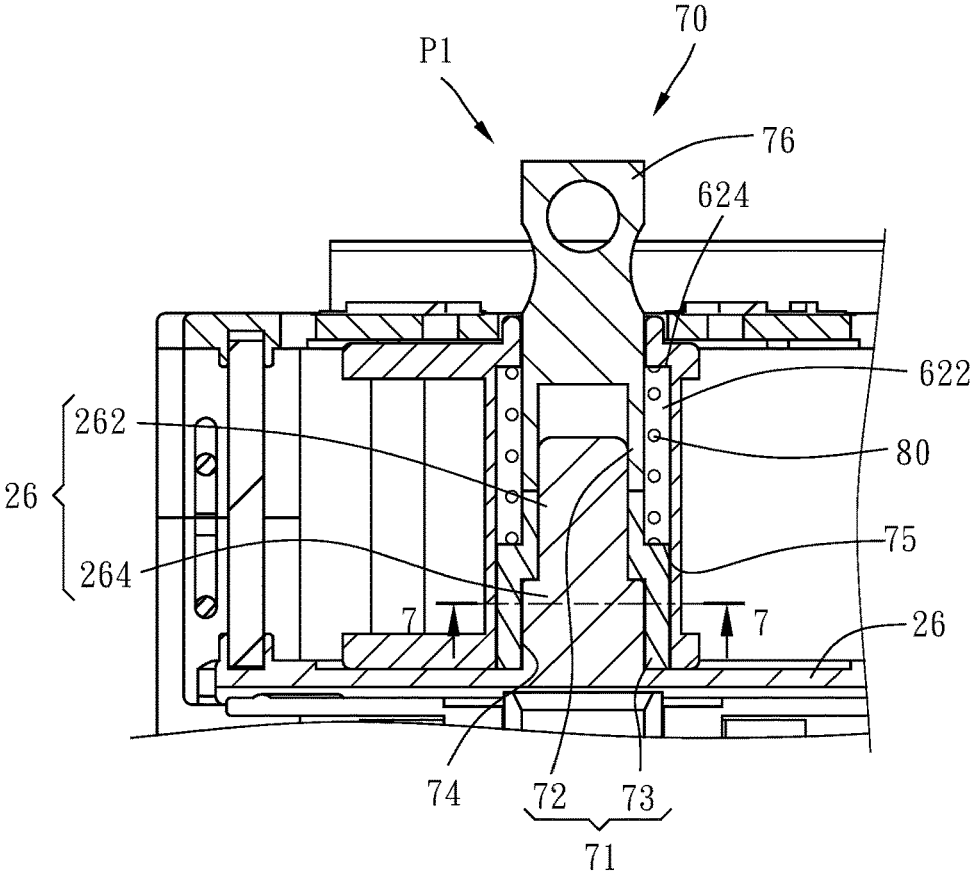
FIG. 6 is a sectional view of the resistance adjusting module provided in the side-inserted cord rolling device of the present invention, primarily showing a pull pin is located at a positioning position.

The transmission seat 60 is rotatably disposed between the upper half seat and the middle plate 25 of the base 20. The transmission seat 60 has a transmission shaft 62 provided with a polygonal transmission hole 622 such as the octagonal hole shown in FIG. 7. The polygonal transmission hole 622 is provided at the top end of the inner wall thereof with an inner shoulder portion 624 as shown in FIG. 6. The size of the polygonal transmission hole 622 is larger than the outer radius of the fixed shaft 26 of the middle plate 25, so the transmission seat 60 can be sleeved onto the fixed shaft 26 of the middle plate 25 by means of the polygonal transmission hole 622 of the transmission shaft 62 in a way that the transmission seat 60 is freely rotatable relative to the base 20. As shown in FIG. 4, the transmission seat 60 further has a top flank plate 64, a bottom flank plate 66 and five vertical rods 68. The top and bottom flank plates 64 and 66 are connected to the top and bottom ends of the transmission shaft 62. The vertical rods 68 are connected with the top and bottom flank plates 64 and 66, arranged at intervals, and archedly center around the center of the polygonal transmission hole 622 of the transmission shaft 62.

Figure 7:
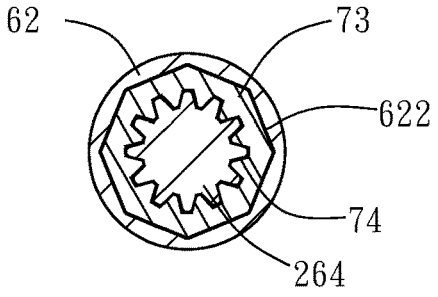
FIG. 7 is a sectional view taken along the line 7-7 in FIG. 6.
Figure 8:
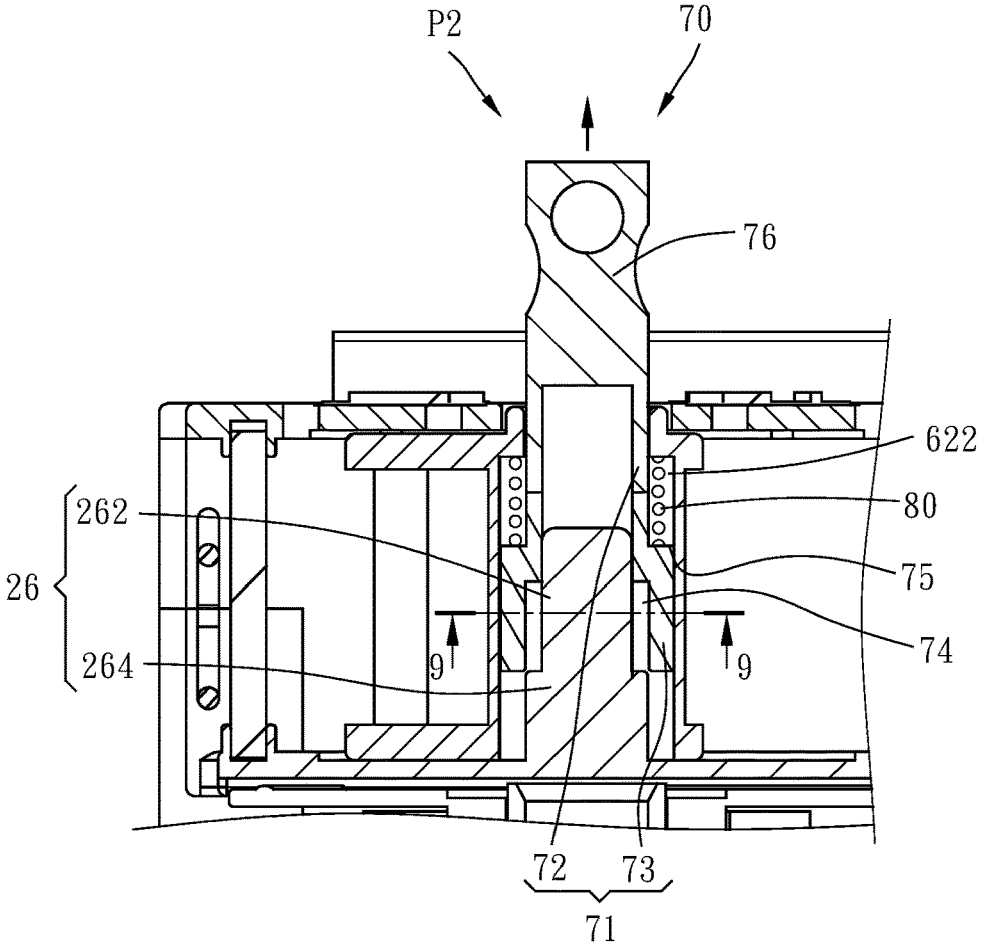
FIG. 8 is another sectional view of the resistance adjusting module provided in the side-inserted cord rolling device of the present invention, primarily showing the pull pin is located at an adjusting position.
Figure 9:
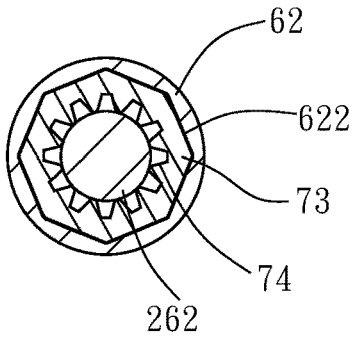
FIG. 9 is a sectional view taken along the line 9-9 in FIG. 8.

The pull pin 70 has a driving shaft 71 provided with an outer axial portion 72, a polygonal driving portion 73 such as the octagonal portion shown in FIGS. 4 and 7, and a toothed positioning groove 74 as shown in FIG. 7. The outer axial portion 72 is circular in cross-section thereof. The top end of the polygonal driving portion 73 is integrally connected with the bottom end of the outer axial portion 72 so that an outer shoulder portion 75 is formed therebetween, as shown in FIG. 6. The positioning groove 74 is provided at the bottom end of the polygonal driving portion 74. Besides, the polygonal driving portion 73 of the driving shaft 71 of the pull pin 70 is embedded in the polygonal transmission hole 622 of the transmission shaft 62 of the transmission seat 60 in a way that the pull pin 70 is vertically displaceable. When the pull pin 70 is located at a positioning position P1 as shown in FIG. 6, the outer axial portion 72 of the driving shaft 71 of the pull pin 70 is sleeved onto the inner axial portion 262 of the fixed shaft 26 of the middle plate 25, and the positioning groove 74 of the driving shaft 71 of the pull pin 70 is engaged with the positioning portion 264 of the fixed shaft 26 of the middle plate 25 as shown in FIG. 7, so that the pull pin 70 is disabled from driving the transmission seat 60 to rotate together relative to the base 20. In opposite, when the pull pin 70 is located at an adjusting position P2 as shown in FIG. 8, the outer axial portion 72 of the driving shaft 71 of the pull pin 70 is still sleeved onto the inner axial portion 262 of the fixed shaft 26 of the middle plate 25, but the positioning groove 74 of the driving shaft 71 of the pull pin 70 is separated from the positioning portion 264 of the fixed shaft 26 of the middle plate 25. At this time, the matching of the polygonal driving portion 73 of the driving shaft 71 of the pull pin 70 and the polygonal transmission hole 622 of the transmission shaft 62 of the transmission seat 60 as shown in FIG. 9 enables the pull pin 70 to drive the transmission seat 60 to rotate together relative to the base 20.

Figure 10:
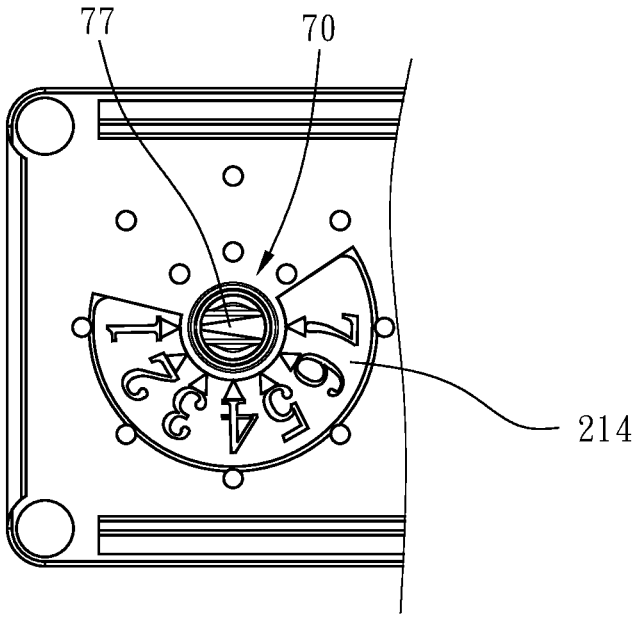
FIG. 10 is a partial top view of the side-inserted cord rolling device of the present invention.

As shown in FIGS. 2 and 4, the pull pin 70 further has an operating portion 76 which is integrally connected to the top end of the outer axial portion 72 of the driving shaft 71 and inserted through the top hole 212 of the upper half seat 21 of the base 20 to protrude from the upper half seat 21 of the base for being operated by the user conveniently. The top end of the operating portion 76 of the pull pin 70 has an indicating symbol 77 such as the arrow shown in the figures. When the pull pin 70 is located at the positioning position P1 as shown in FIG. 6, the indicating symbol 77 of the operating portion 76 corresponds to one of the state marks 214, as shown in FIG. 10.

The elastic member 80 is sleeved onto the outer axial portion 72 of the pull pin 70 and abutted between the inner and outer shoulder portions 624 and 75 for providing elastic force to keep the pull pin 70 located at the positioning position P1 as shown in FIG. 6.

Figure 11:
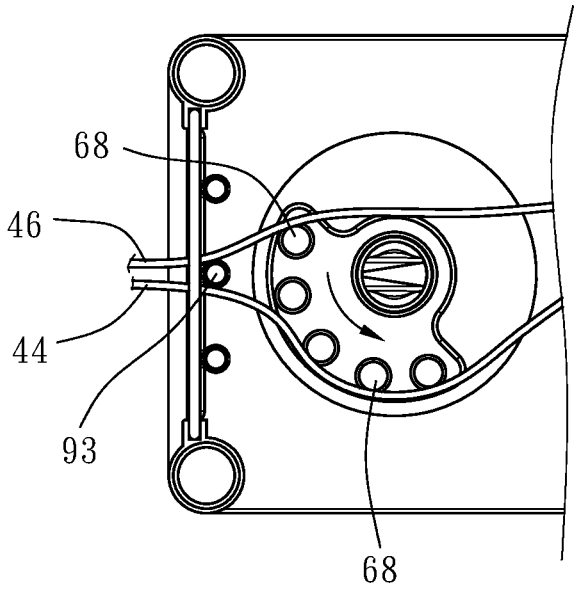
FIG. 11 is a partial top view of the side-inserted cord rolling device of the present invention when an upper half seat thereof is removed, primarily showing two lift transmission cords are pushed by vertical rods.

In practical operation, the operating portion 76 of the pull pin 70 is firstly used to let the pull pin 70 be pulled up from the positioning position P1 as shown in FIG. 6 to the adjusting position P2 as shown in FIG. 8, so that the positioning groove 74 of the driving shaft 71 of the pull pin 70 is separated from the positioning portion 264 of the fixed shaft 26 of the middle plate 25. At this time, the elastic member 80 is compressed by the outer shoulder portion 75 of the pull pin 70 to save the resilient force. After that, the pull pin 70 can be rotated. During the rotation of the pull pin 70, the engagement between the polygonal driving portion 73 of the driving shaft 71 of the pull pin 70 and the polygonal transmission hole 622 of the transmission shaft 62 of the transmission seat 60 causes the transmission seat 60 to rotate with the pull pin 70. As shown in FIG. 11, the transmission seat 60 at this time can push the two lift transmission cords 44 and 46 by one or a plurality of vertical rods 68, enabling the cord arrangement of the two lift transmission cords 44 and 46 to be adjusted, thereby attaining the effect of resistance adjustment. During the aforesaid adjustment, the user can control the magnitude of the resistance by means of the indicating symbol 77 of the pull pin 70 and the state marks 214 of the upper half seat 21 of the base 20, as shown in FIG. 10. The larger number the state mark 214 shows, the larger angle the pull pin 70 drives the transmission seat 60 to rotate and the larger resistance the two lift transmission cords 44 and 46 is applied with.

When the adjustment is finished, as long as the pull force applied on the pull pin 70 is relieved, the pull pin 70 will be moved back to the positioning position P1 as shown in FIG. 6 by the resilient force of the elastic member 80, so that the positioning groove 74 of the driving shaft 71 of the pull pin 70 is engaged with the positioning portion 264 of the fixed shaft 26 of the middle plate 25. At this time, the pull pin 70 is unable to be rotated, so the transmission seat 60 is also unable to rotate together.

In addition, as shown in FIGS. 2 and 4, the resistance adjusting module 50 further has a limiting ring 90 and a guiding rod 93. The limiting ring 90 is disposed between the upper half seat 21 and the middle plate 25 of the base 20 and located at the upper half portion 242 of the opening 24. The guiding rod 93 is disposed between the upper half seat 21 and the middle plate 25 of the base 20 and located between the limiting ring 90 and the transmission seat 60. Besides, the limiting ring 90 has an upper transverse rod 91 and a lower transverse rod 92 parallel to the upper transverse rod 91. The guiding rod 93 is disposed perpendicularly to the upper and lower transverse rods 91 and 92 of the limiting ring 90. As a result, when the two lift transmission cords 44 and 46 are inserted through the upper half portion 242 of the opening 24 to be extended out of the base 20, the lift transmission cord 44 is abutted on the intersection of the upper transverse rod 91 of the limiting ring 90 and the guiding rod 93, and the lift transmission cord 46 is abutted on the intersection of the lower transverse rod 92 of the limiting ring 90 and the guiding rod 93. In this way, the two lift transmission cords 44 and 46 are limited by the limiting ring 90 to operate in specific areas and guided by the guiding rod 93 to be prevented from being wound and knotted.

On the other hand, as shown in FIGS. 1-2, when being installed in the top beam 12, the whole cord rolling device 10 can be embedded into the top beam 12 through an end of the top beam 12 in a way that the guideways 216 of the upper half seat 21 of the base 20 are engaged with two opposite protruded edges 14 of the top beam 12, and the cord rolling device 10 can be positioned in a way that the end plate 23 of the base 20 is abutted on the end surface of the top beam 12. Because the end plate 23 of the base 20 is exposed out of the top beam 12, it can be used to let the whole cord rolling device 10 drawn out of the top beam 12 so as to be removed from the top beam 12.

In conclusion, the side-inserted cord rolling device 10 of the present invention can be quickly installed at and removed from an end of the top beam 12. Besides, during the operation, the resistance applied on the lift transmission cords 44 and 46 can be adjusted as long as the pull pin 70 is pulled up to the adjusting position P2. The whole process needs no structural disassembly and assembly, so that the usage convenience is increased and the assembly accuracy can be maintained.

What is claimed is:

1. A side-inserted cord rolling device for a non-pull cord window blind, the side-inserted cord rolling device comprising:

a base, the base being provided at an end thereof with an end plate, the base being provided at another end thereof with an opening, the base including an upper half seat and a lower half seat connected with the upper half seat, the upper half seat being provided at an end thereof with an upper end portion, the lower half seat being provided at an end thereof with a lower end portion, the upper end portion of the upper half seat and the lower end portion of the lower half seat being abutted against each other to define the end plate, the base further including a middle plate disposed between the upper half seat and the lower half seat of the base;

a first wheel rotatably disposed on the base and located adjacent to the end plate of the base, the first wheel having a top layer, a middle layer and a bottom layer, the top layer and the middle layer being separated by a disc portion, the middle layer and the bottom layer being separated by another disc portion;

a second wheel rotatably disposed on the base and located adjacent to the opening of the base, the second wheel being disposed between the middle plate and the lower half seat, the middle plate having a side facing the upper half seat and the side being provided with a fixed shaft having a positioning portion;

a torsion spring connecting the bottom layer of the first wheel and the second wheel;

two lift transmission cords, an end of one of the two lift transmission cords being connected to the top layer of the first wheel, an end of the other lift transmission cord being connected to the middle layer of the first wheel, another end of each of the two lift transmission cords being inserted through the opening of the base to be located out of the base; and a resistance adjusting module having a transmission seat and a pull pin, the transmission seat having a transmission shaft and a plurality of vertical rods, the transmission shaft having a polygonal transmission hole rotatably sleeved onto the fixed shaft of the middle plate, the vertical rods being disposed around the transmission shaft and abutted against the two lift transmission cords, the pull pin having a polygonal driving portion and a positioning groove provided on the polygonal driving portion, the polygonal driving portion of the pull pin being embedded in the polygonal transmission hole of the transmission shaft of the transmission seat in a way that the pull pin is vertically displaceable; wherein when the pull pin is located at a positioning position, the positioning groove of the pull pin is engaged with the positioning portion of the fixed shaft of the middle plate, so that the pull pin is disabled from driving the transmission seat to rotate together relative to the base, and when the pull pin is located at an adjusting position, the positioning groove of the pull pin is separated from the positioning portion of the fixed shaft of the middle plate, so that the pull pin is enabled to drive the transmission seat to rotate together relative to the base.

2. The side-inserted cord rolling device as claimed in claim 1, wherein the upper half seat of the base is provided on a top surface thereof with two opposite guideways.

3. The side-inserted cord rolling device as claimed in claim 1, wherein the transmission seat further has a top flank plate and a bottom flank plate; the top flank plate and the bottom flank plate are connected to top and bottom ends of the transmission shaft; the vertical rods are connected with the top flank plate and the bottom flank plate, arranged at intervals, and radially spaced from a center of the polygonal transmission hole of the transmission shaft.

4. The side-inserted cord rolling device as claimed in claim 1, wherein the resistance adjusting module further has a limiting ring and a guiding rod; the limiting ring is disposed at an end of the base and located adjacent to the opening; the limiting ring has an upper transverse rod and a lower transverse rod parallel to the upper transverse rod; the guiding rod is disposed between the upper half seat of the base and the middle plate perpendicularly to the upper transverse rod and the lower transverse rod of the limiting ring; the two lift transmission cords are inserted through the limiting ring; one of the lift transmission cords is abutted on an intersection of the upper transverse rod of the limiting ring and the guiding rod; the other lift transmission cord is abutted on an intersection of the lower transverse rod of the limiting ring and the guiding rod.

5. The side-inserted cord rolling device as claimed in claim 1, wherein the polygonal transmission hole is provided at a top end of an inner wall thereof with an inner shoulder portion; the pull pin further has an outer axial portion which is circular in cross-section thereof; the outer axial portion is located adjacent to a top end of the polygonal driving portion, and an outer shoulder portion is formed between the outer axial portion and the polygonal driving portion; the resistance adjusting module further has an elastic member which is sleeved onto the outer axial portion of the pull pin and abutted between the inner shoulder portion and the outer shoulder portion for keeping the pull pin located at the positioning position.

6. The side-inserted cord rolling device as claimed in claim 5, wherein the upper half seat of the base has a top hole; the pull pin further has an operating portion which is connected to a top end of the outer axial portion and protrudes from a top surface of the upper half seat of the base through the top hole of the base.

7. The side-inserted cord rolling device as claimed in claim 6, wherein the top surface of the upper half seat of the base is provided with a plurality of state marks located around the top hole; the operating portion of the pull pin has an indicating symbol; when the pull pin is located at the positioning position, the indicating symbol corresponds to one of the state marks.

8. The side-inserted cord rolling device as claimed in claim 5, wherein the fixed shaft of the middle plate further has an inner axial portion which is circular in cross-section thereof; the inner axial portion is connected to a top end of the positioning portion; the outer axial portion of the pull pin is sleeved onto the inner axial portion of the fixed shaft of the middle plate in a way that the pull pin is displaceable vertically and rotatable.

* * * * *